US008850641B2

(12) United States Patent
Marbury, III

(10) Patent No.: US 8,850,641 B2
(45) Date of Patent: Oct. 7, 2014

(54) BODY POSITIONING SYSTEM

(75) Inventor: Clinton Mac Marbury, III, Los Angeles, CA (US)

(73) Assignee: Halo Mac Enterprise, Marina Del Rey, CA (US)

( * ) Notice: Subject to any disclaimer, the term of this patent is extended or adjusted under 35 U.S.C. 154(b) by 0 days.

(21) Appl. No.: 13/595,931

(22) Filed: Aug. 27, 2012

(65) Prior Publication Data

US 2014/0053337 A1 Feb. 27, 2014

(51) Int. Cl.

| | |
|---|---|
| ***A47G 9/10*** | (2006.01) |
| ***A47C 7/42*** | (2006.01) |
| ***A47C 20/00*** | (2006.01) |
| ***A47C 20/02*** | (2006.01) |

(52) U.S. Cl.

CPC ..... *A47G 9/1054* (2013.01); *A47C 7/425* (2013.01); *A47C 20/021* (2013.01); *A47C 20/026* (2013.01)

USPC ..... 5/638; 5/632; 5/643; 5/652.1

(58) Field of Classification Search

USPC ..... 5/622, 630, 632, 633, 637, 638, 643, 5/648, 652.1, 657

See application file for complete search history.

(56) References Cited

U.S. PATENT DOCUMENTS

| | | | | |
|---|---|---|---|---|
| 2,807,033 | A | 9/1957 | Austen | |
| 3,140,497 | A | 7/1964 | Carswell | |
| 3,315,282 | A | 4/1967 | Lowery | |
| 3,926,181 | A * | 12/1975 | Eischen, Sr. | 602/18 |
| 5,546,619 | A * | 8/1996 | Braun | 5/638 |
| 5,970,546 | A * | 10/1999 | Danis | 5/636 |
| 6,081,947 | A | 7/2000 | Disher | |
| 6,128,797 | A | 10/2000 | Shaffer | |
| 6,230,350 | B1 | 5/2001 | Goldstein | |
| 6,842,924 | B1 | 1/2005 | Walters | |
| 7,020,918 | B1 | 4/2006 | Tinsley | |
| 8,006,335 | B1 | 8/2011 | Andermann | |
| 2010/0205743 | A1 * | 8/2010 | Harges | 5/638 |

FOREIGN PATENT DOCUMENTS

| | | |
|---|---|---|
| CN | 201710624 U | 1/2011 |

* cited by examiner

*Primary Examiner* — Michael Trettel

(74) *Attorney, Agent, or Firm* — Jean-Que M. Dar; IP Precise

(57) ABSTRACT

A pillow (10) in the form of a ring (20) extending around a vertical axis (22), with a gap (24) between front ends (26, 28) of the pillow. A person can lie in a prone position with his/her face lying facedown in the vertical aperture (54) formed by the ring and with the periphery of the person's face supported by the upper surface of the ring. The pillow front ends and a rear portion (32) project downward to leave tunnels (Q) at opposite sides though which the person can breath. The person's chin projects into the gap between the pillow front ends. A separate chest support (12) has a rear portion of a soft elastomer that can support the person's abdomen, and has a front portion of a stiffer elastomer for supporting the chest.

6 Claims, 3 Drawing Sheets

BODY POSITIONING SYSTEM

BACKGROUND OF THE INVENTION

A pillow is usually used to support a person in the reclined position wherein the head faces upward or to one side. A special pillow of the invention can be used to support a person in the prone position wherein the head generally faces downward. It would be desirable if such a special pillow supported itself stably on a horizontal surface such as a bed and if the pillow were useful in a variety of circumstances.

SUMMARY OF THE INVENTION

In accordance with one embodiment of the invention, a body support is provided that includes a pillow that can support a person's head in the prone position (head facing down), as when the person's back is being massaged The pillow is in the form of a ring that extends by almost a circle around a vertical axis. The front of the ring has a gap that results in two pillow front ends that can be separated. The pillow has a rear end that projects downward, (relative to opposite sides). The pillow front ends also project downward, to support the pillow front stably on a flat surface such as the surface of a bed. The downward-projecting front ends and roar end result in raised opposite sides of the pillow that allow air to flow inward and outward to the person's nose and mouth.

A person can lie in a prone position with the periphery of his/her face supported on an inner portion of the ring. The person's chin separates the pillow opposite front ends and preferably lies above the bed or other horizontal support surface on which the pillow lies.

A person can place the pillow on the back of an airplane seat to support the person's head even if the person's head faces sideways.

The body support can include a chest support that supports the chest of a person whose head faces downward into the pillow. The chest support is preferably unconnected to the pillow. The chest support preferably has a rear end of soft elastomeric material to support a person's abdomen, and has a stiffer front end to support the person's chest. This allows for easier breathing and diaphragm movement.

The novel features of the invention are set forth with particularity in the appended claims. The invention will be best understood from the following description when read in conjunction with the accompanying drawings.

DESCRIPTION OF THE INVENTION

Figure 1:
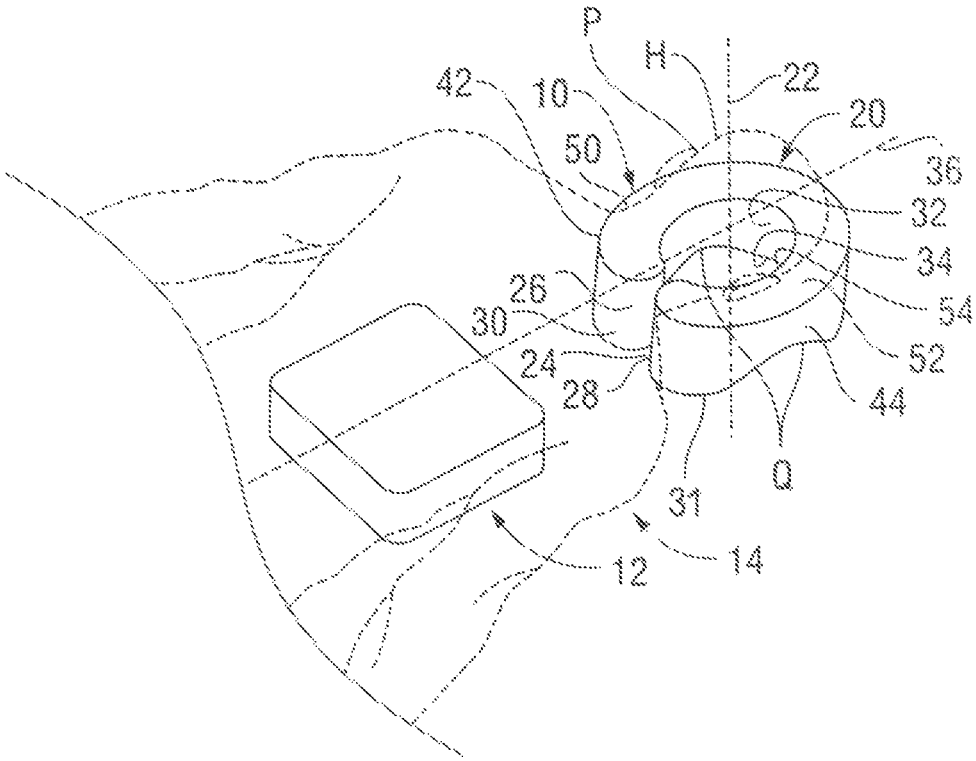
FIG. 1 is an isometric view of a body support of the invention, with phantom lines showing a person lying in a prone position facing downward into the pillow and lying on the chest support.
Figure 2:
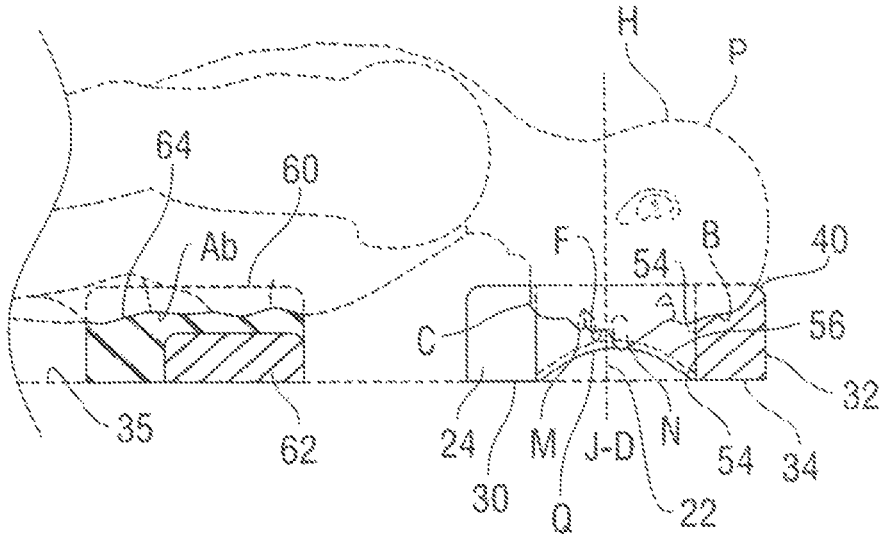
FIG. 2 is sectional side view of the pillow and chest support of FIG. 1, and showing a person in phantom lines.
Figure 3:
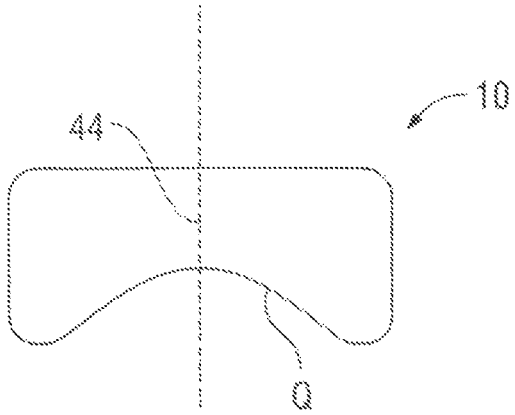
FIG. 3 is a side elevation view of the pillow of FIG. 2.
Figure 4:
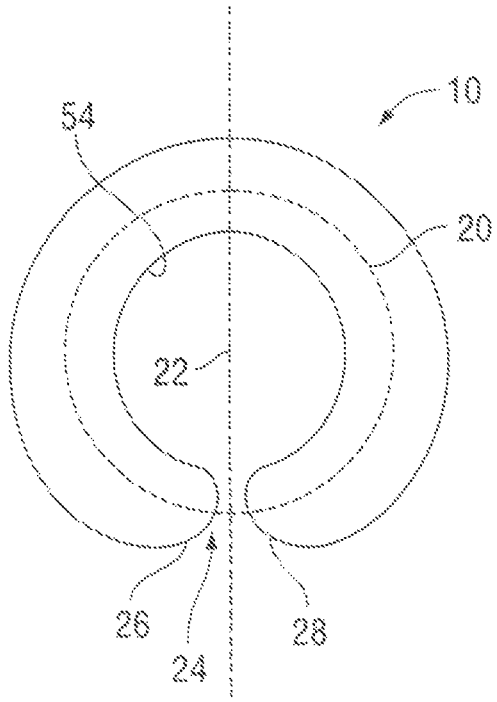
FIG. 4 is a plan view of the pillow of FIG. 2.

FIGS. 1 and 2 show a pillow, or pillow element 10 and a chest support 12, of a body support arrangement 14. The pillow 10 supports the head H of a person P who lies in a prone position, that is, with the face F (FIG. 2) of the person facing downwardly D. The pillow is generally in the form of a horizontal ring 20 (FIG. 4) that is centered on a vertical axis 22, except that the ring has an interruption or gap 24 at front ends 26, 28 of the pillow. The pillow front ends have downward-projecting bottoms 30, 32 (FIG. 1) and the pillow has a rear end 32 with a downward-projecting bottom 34, all for resting on a horizontal surface 35. The pillow is symmetric about a forward-rearward centerline 36. FIG. 3 shows that the pillow lower surface extends in an upward curve between each end and an adjacent side.

Figure 5:
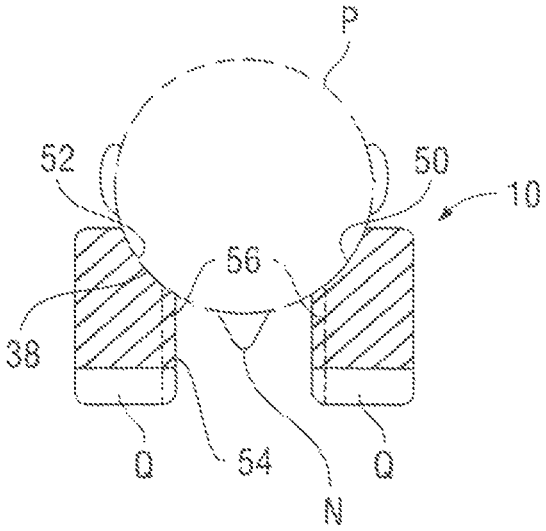
FIG. 5 is a sectional rear view of the pillow of FIG. 2, showing the person in phantom lines.

FIG. 2 shows that a peripheral portion of the person's face includes his/her forehead B that lies on the top 40 of the rear end 32 of the pillow. The person's sides or cheeks 38 (FIG. 5) also lie on the pillow top. The person has a chin C (FIG. 2) that lies in the gap 24 of the pillow ring. The person has opposite left and right sides that are supported on tops, or top portions 50,52 (FIG. 5) of the pillow sides while the person's face lies in a large vertical pillow aperture 54. The pillow sides are preferably identical, and each has a passage Q through which air can flow to or from the person's nose N and mouth M. The side walls 42, 44 (FIG. 1) above the tunnels Q protest the person's head.

Applicant can construct the pillow 10 primarily of soft foam, and still prevent the passages Q from collapsing. This can be done by providing arch inserts 56 (FIG. 5) of stiffer material than the rest of the pillow. Softer foam can be positioned at the top of the rear end 32 (FIG. 2). This allows the head to tilt backward.

The pillow 10 end chest support 12 are especially useful to support a person whose back is being massaged. FIG. 2 shows that the person's chest lies on a very soft portion 60 of the chest support. The chest support includes a moderately stiff elastomeric insert 62. The person's abdomen Ab lies on a rear portion 64 of the chest support. The rear portion 64 is formed of resilient elastomeric material (e.g. Young's modulus under $50\times10^3$ psi) that is softer than the material of the chest insert 62.

Figure 6:
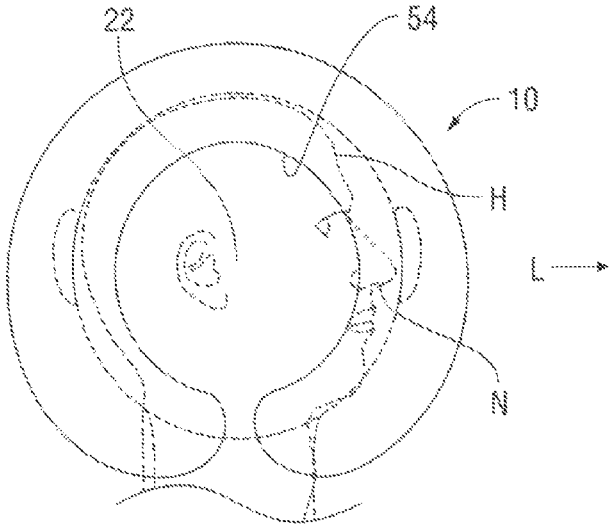
FIG. 6 is plan view of the pillow of FIG. 1 as positioned on an airplane seat, with the rear end of the pillow being uppermost.
Figure 7:
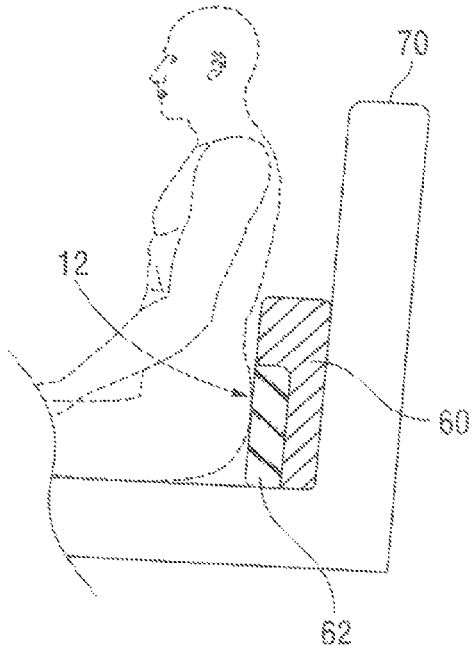
FIG. 7 is a side elevation view of the pillow of FIG. 6 lying on an airplane seat.

FIG. 7 shows a person sitting on the type of seat 70 that is commonly found in an airliner and that can be reclined, and with a chest support 12 against the person's back. The stiff insert 62 supports the lower back, while the very soft portion 60 supports the rest of the back. On a long flight, especially one that occurs in the evening or at night, a person may fall asleep and tilt his/her head far to the left or right. FIG. 6 shows a person's head H tilted to his left L. The person's head then may tilt against the shoulder of another person sitting in an adjacent seat (and possibly drool on that person). This can be embarrassing. Applicant uses the pillow 10 to avoid such side shift of his/her head. When the person's head lies in the pillow aperture as in FIG. 6, the pillow limits tilt to one side and limits sideward shift of the head.

Figure 8:
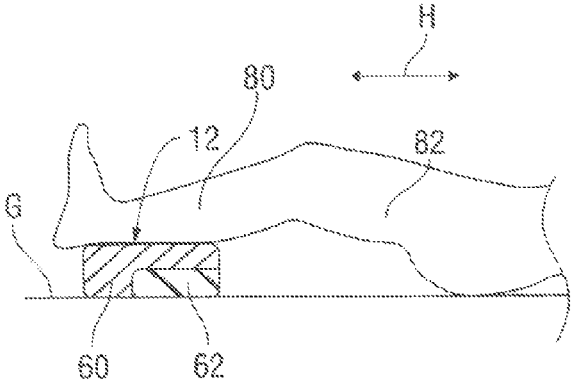
FIG. 8 is a sectional view of FIG. 7, when used to sopped a person's leg.

FIG. 8 shows the chest support 12 being used to support a person's lower leg 80. The lower leg position of FIG. 8 is raised about 4.5 inches above the ground G and the lower leg 80 extends close (preferably within ±10°) to the horizontal H. The soft material 60 supports the calf for more natural alignment of the lumbar back and spine. This avoids back aches that might occur if the upper legs 82 extended horizontally. A person may lift weights while his legs are supported as shown.

The chest support has a portion 60 that the leg rests on of soft (preferably elastomeric) material and has an insert 62 of stiffer material.

Thus, the invention provides a body support that includes a pillow element and that may also include a chest support. The pillow is in the form of a ring centered on a primarily vertical axis and forming a primarily vertical large aperture that can receive the face of a person. The ring has a gap that forms opposite front ends of the pillow, and the ring has a rear end that lies opposite the two front ends. Bottoms of the front end and of the rear of the pillow project further downward than opposite sides of the pillow, to leave side tunnels that allow the passage of air to the person, with the side walls lying above the tunnels. The pillow is also useful in an airplane to limit sideward movement of a person" head.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A body positioning system comprising:

a pillow element that extends around a vertical axis (22) and that has adjacent front ends (26, 28) and a rear portion (32) and forming a vertical aperture (54) within the pillow element, said adjacent front ends and said rear portion having bottoms positioned to rest the pillow on a horizontal surface;

said pillow element having an upper surface (40) that supports the forehead (B) and left and right sides of the head of a person, said pillow element has opposite side walls (42, 44), and said side walls have bottoms that form at least one air tunnel (Q) through which air can pass;

said pillow element being constructed of resilient foam and forming said opposite sides (42, 44), a front end (26, 28), and a rear end (32), said pillow element having a lower surface extending between each end and an adjacent side to leave one of said air tunnels (Q) at each of said opposite sides, and said pillow element extending in a downward curve at said front and rear ends (26, 28, 32) to leave curved downward-projecting bottoms (34) at said front and rear ends to support the pillow element on a horizontal surface.

2. The body positioning system described in claim 1 wherein:

said pillow is formed primarily of soft foam, but said pillow includes a pair of arches (56) of resilient material that is stiffer than said soft foam and that form walls of said tunnel to prevent their collapse.

3. A body positioning system comprising:

a pillow element that extends around a vertical axis (22) and that has adjacent front ends (26, 28) and a rear portion (32) and forming a vertical aperture (54) within the pillow element, said adjacent front ends and said rear portion having bottoms positioned to rest the pillow on a horizontal surface;

said pillow element having an upper surface (40) that supports the forehead (B) and left and right sides of the head of a person, said pillow element has opposite side walls (42, 44), and said side walls have bottoms that form at least one air tunnel (Q) through which air can pass;

a chest support (12) of soft resilient material having front and rear portions (60, 64), said chest support having top and bottom portions, with said front portion having an insert (62) of more rigid material than said soft material and lying in a lower end of said front portion;

said chest support resting on said horizontal surface with said insert lying at a font most and lowermost part of said chest support, whereby to support the person's chest without hurting the person's abdominal (Ab).

4. The body positioning system described in claim 3 wherein:

aid chest support is free of connection to said pillow element.

5. A body positioning system comprising:

a pillow in the form of an interrupted ring extending by most of a circle around an axis (22) and having front ends that can be separated, the pillow having a rear end (32) on a side of said axis opposite said front ends, said pillow having top and bottom portions, said pillow having opposite side walls (42, 44) each lying between one of said front ends and said rear end;

a bottom portion (30, 32) of each of said front ends and a bottom of said rear end each projecting downward beyond said opposite side walls of said pillow and leaving said opposite side walls with tunnels (Q) through which air can pass;

wherein said pillow is formed primarily of soft foam, but said pillow includes a pair of arches (56) of resilient material that is stiffer than said soft foam and that forms walls of said tunnels to prevent their collapse.

6. A body positioning system for use by a person who lies in a prone position on a generally horizontal surface, comprising:

a pillow element that extends around a vertical axis (22) and that has adjacent front ends (26, 28) and a rear portions (32) and forming a vertical aperture (54) within the pillow element, said adjacent front ends and said rear portion having bottoms positioned to rest the pillow on a horizontal surface;

said pillow element having an upper surface (40) for supporting the forehead (B) and left and right sides of the head of the person with the person's neck (N) lying between said pillow element front ends, said pillow element has opposite side walls (42, 44), and said side walls have bottoms that form at least one air tunnel (Q) through which air can pass;

said pillow element front ends positioned with a gap between them to receive the person's chin (C) between said pillow element front ends and to separate said pillow front ends.

* * * * *